US005192222A

United States Patent [19]

Krause et al.

[11] Patent Number: 5,192,222

[45] Date of Patent: Mar. 9, 1993

[54] PLUG CONNECTION DEVICE FOR SIMULTANEOUS MECHANICAL AND ELECTRICAL CONNECTION OF TWO ELECTRONIC UNITS

[75] Inventors: Klaus D. Krause, Dietenhofen; Rudolf Schmeykal, Hemhofen; Florian Stolzenberger, Altenthann, all of Fed. Rep. of Germany

[73] Assignee: Ta Triumph-Adler AG, Nuremberg, Fed. Rep. of Germany

[21] Appl. No.: 766,434

[22] Filed: Sep. 26, 1991

[30] Foreign Application Priority Data

Oct. 16, 1990 [DE] Fed. Rep. of Germany ..... 4032801

[51] Int. Cl.[5] ..... H01R 4/50

[52] U.S. Cl. ..... 439/347; 439/310

[58] Field of Search ..... 439/157, 310, 347, 135, 439/136, 149, 586, 595, 718

[56] References Cited

U.S. PATENT DOCUMENTS

| | | | |
|---|---|---|---|
| 3,392,245 | 7/1968 | Asick | 439/347 X |
| 3,425,025 | 1/1969 | Williams | 439/347 |
| 4,558,914 | 12/1985 | Prager et al. | 439/347 X |
| 4,853,830 | 8/1989 | Corfits et al. | 439/372 X |

FOREIGN PATENT DOCUMENTS

| | | | |
|---|---|---|---|
| 3730020 | 9/1988 | Fed. Rep. of Germany | 439/347 |
| 2138221 | 10/1984 | United Kingdom | 439/347 |

*Primary Examiner*—Larry I. Schwartz
*Assistant Examiner*—Khiem Nguyen
*Attorney, Agent, or Firm*—Michael J. Striker

[57] ABSTRACT

The plug connection device for mechanical and electrical plug connection of one electronic unit having a first housing (1) with another electronic unit having a second housing (2) includes an electronic plug (5) in the one unit and a socket (6) for the plug (5) in the other unit, and a mechanical locking device separate from the electronic plug (5) in the one unit. The mechanical locking device includes an operating rod or bar (7,7') slidable parallel to a wall of the one unit; at least two plate-like lock studs (10) extending inclined to the wall of the one unit and correspondingly inclined running surfaces (15) bounding lock stud recesses (13) provided in the rear wall of the other electronic unit. After the units are pushed together, the plate-like lock studs (10) are slidable by sliding the operating rod or bar substantially parallel to the wall of the one unit, so that the lock studs (10) engage in the lock stud recesses (13) of the other electronic unit (2) interiorly of running surfaces (15) provided in the second electronic unit (2), the lock studs (10) contacting and running on the running surfaces (15) during electrical connection of the plug and socket.

8 Claims, 4 Drawing Sheets

PLUG CONNECTION DEVICE FOR SIMULTANEOUS MECHANICAL AND ELECTRICAL CONNECTION OF TWO ELECTRONIC UNITS

BACKGROUND OF THE INVENTION

The present invention relates to a plug connection device for mechanically and electrically connecting electronic units. The plug connection device includes a plug and a plug socket.

For two or more electronic units it is often necessary to make and maintain a definite mechanical relationship between their housings and, at the same time as making mechanical connection of the units, many very sensitive multipole electrical connections must also be made, which require a considerable applied force to make as well as accurate connection work. Portable computers, so-called Laptops and Docking Stations and/or Printers are included in this type of electronic unit. Because of the necessary applied force required to make the connections, there is a danger that in making the plug connections an inadvertent torque can occur, which can damage the sensitive plug contacts.

Known multipole plug connections necessarily also lead to making a mechanical connection, in which the strength of connection is not sufficient to reliably hold the housings together and to prevent forces from acting on the electrical contacts, if, for example, one of the electronic units is mistakenly pushed.

Accordingly, any additional special mechanical connection provided must be designed so that it is as inconspicuous as possible, space-saving, not overly complicated, so as to require a complicated explanation and it should be easy to make and break manually. Moreover, a mechanical connection must be attainable independently of the specific housing shape so as to be able to connect entirely different electronic devices in the same way with each other.

SUMMARY OF THE INVENTION

It is an object of the present invention to provide a plug connection arrangement of the above described type, which is formed so that different electronic units are connectable mechanically rigidly.

It is another object of the present invention to provide a plug connection arrangement of the above described type, in which the force involved in making and breaking the plug connection is as low as possible and a simple and secure manual connection should be possible.

These objects and others which will be made more apparent hereinafter are attained in a plug connection device for mechanical and electrical plug connection of a first electronic unit having a first housing with a second electronic unit having a second housing, the connection device including an electronic plug and a plug socket.

According to the invention, a mechanical locking means separate from the electronic plug and plug socket is provided. The electronic plug is provided in the first housing and the plug socket is provided in the second housing(although, of course, the definition of first and second housing and first and second electronic unit is arbitrary—i.e. the plug could be provided in the second housing and the socket in the first housing). The mechanical locking means comprises an operating device, at least two plate-like lock studs extending from the first housing inclined to an insertion direction of the electronic plug in the plug socket and correspondingly inclined running surfaces at least partially forming lock stud recesses provided in the second housing. The lock studs engage in the lock recesses of the second housing during the electrical and mechanical connection of the electronic units and the lock studs are slidable by the operating device in a direction substantially perpendicular to the insertion direction of the electronic plug in the plug socket, so that the lock studs engage in the lock stud recesses of the second housing interiorly on the running surfaces and the lock studs contact and run on the running surfaces of the second electronic unit.

This means, in other words, that the two electronic units according to the invention are pushed together in the insertion direction of the electrical plug-socket connection so that the protruding lock studs of the first housing engage in the lock stud recesses in a rear wall of the second housing, so that, when the operating device is operated, the lock studs now slide or run on the inclined running surfaces of the second housing in the recesses and because of that the housings of both electronic units are pulled together so that the electronic plug is plugged into the plug socket.

Because of the structure of the invention described above, the electrical socket-plug connection is made in a definite way guided mechanically so that damage due to inadvertent applied torques is avoided. Moreover, a reduction of the necessary applied force to make the connection is attained by the provision of inclined running surfaces depending on the predetermined angle of inclination of the running surfaces. Thus, when the operating device is operated, it moves over a comparatively long operating path with a comparatively small applied force required, because of the inclination of the lock studs and running surfaces, during the electronic and mechanical connection which actually requires only a comparatively small displacement from the previously described pushed together position of the housings of the electronic units.

In one embodiment of the invention, the lock studs have arms which engage in a horizontal slot provided in the inclined running surfaces of the second housing. Accordingly the arms can extend directly from the lock studs, without preventing their running or sliding on the inclined running surfaces. Alternatively, the arms can be bent or offset, which requires comparatively larger recesses in the rear wall of the second electronic unit.

It is advantageous that the operating device is formed by an operating rod, which is guided in the first electronic unit parallel to the outer wall having the electronic plug. This operating rod can protrude outside of a side wall of the housing of the first electronic unit. That means that after pushing the electronic units together the operating rod, since it protrudes from one of the sides, can be manipulated, for example, by pushing it into the housing. Accordingly a sufficiently high operating force is sufficient to operate it comparatively easily. The opposing side walls of the first housing can be provided with through-going holes, which serve for guiding of the operating rod.

It is also advantageously provided that the operating rod and/or its operating displacement is dimensioned so that in one or both end positions for its lateral displacement the operating rod is substantially flush with one of the housing sides and protrudes from the other side.

In an another embodiment of the invention, the operating device comprises a plate-like operating bar, which has a cross-section, particularly a T-shaped cross-section and a dovetailed cross-section, designed for guiding and which is mounted longitudinally slidable in the rear wall of the first housing having the electrical plug. Advantageously, the free outer side of the plate-like operating bar is aligned with the housing wall carrying the plug.

In this other embodiment is can be advantageously provided that, when the operating bar is moved into the connecting or locking position an end of the bar protruding from the side wall of the first housing is foldable to be aligned with the side wall. In this embodiment then one avoids having one end of the operating bar protrude from the combined units, which can be troublesome during operation of the units.

The second electronic unit having the plug socket is formed so that a housing wall portion extends parallel to the inclined running surfaces a distance which correspond approximately to the thickness of the plate-like lock studs. Thus, the housing wall portions and the inclined running surfaces bound the recesses receiving the lock studs.

With this type of structure, the housing is closed to the exterior in the vicinity of the lock stud recesses. furthermore an additional guide surface lowering the play of the lock studs is provided for the lock studs.

To guarantee that in making the electrical connection between the plug and the socket no damage to the electrical contacts occurs, it can be provided that in the vicinity of the plug mechanical guide members projecting in the insertion direction of the plug into the socket are provided. These guide members can be plate-like guide shoulders on each side of the plug, which engage in corresponding guide recesses on each side of the socket, during electrical connection of the electronic plug with the plug socket.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
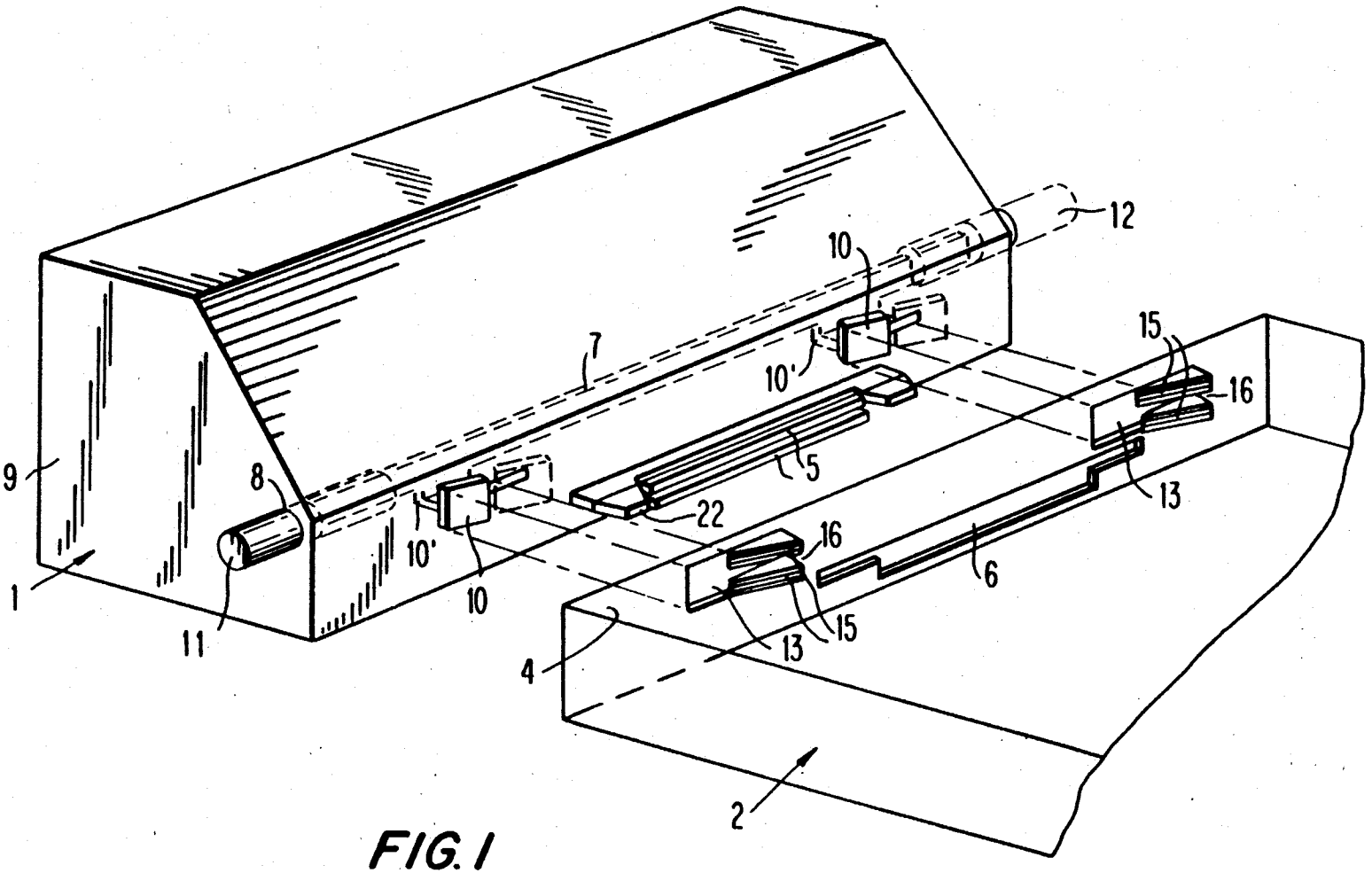
FIG. 1 is a schematic perspective view of two electronic units in the region of connection prior to being connected together.
Figure 2:
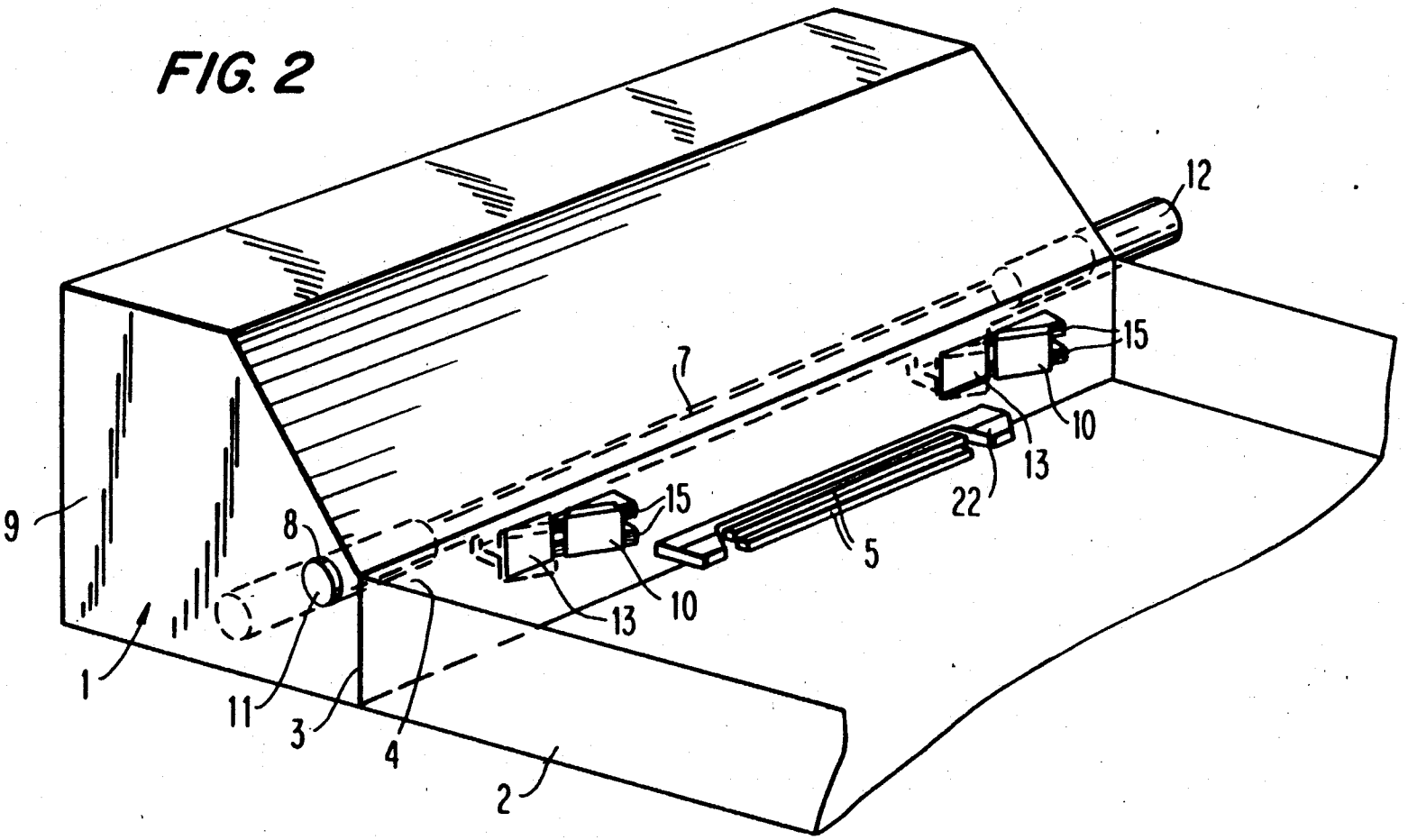
FIG. 2 is another perspective view of the two electronic units of FIG. 1 after being connected together.

A first electronic unit 1 shown in the drawing is for example a so-called docking station, which should be connected with a second electronic unit 2 in the form of a portable computer. The connection should be made through a housing rear wall 3 of the first electronic unit 1 and through a housing rear wall 4 of the second electronic unit 2.

A multipole electrical plug 5 is provided on the housing rear wall 3 and a corresponding plug socket is provided in the housing rear wall 4, which for simplicity is indicated only by a suitable opening 6 in the rear wall 4.

An operating rod 7 with a circular cross-section penetrates through the guide openings 8 in the side walls 9 of the first electronic unit 1, so that the operating rod 7 extends substantially parallel to the rear wall 3. This operating rod 7 is part of the operating device, which makes the mechanical connection between the electronic units 1 and 2.

Plate-like lock studs 10 are attached to the operating rod 7 by arms 10'. These lock studs 10 are spaced from each other and protrude thorough the rear wall 3, which is clearly indicated particularly in FIG. 3. The plate-like lock studs 10 are oriented at an angle $\alpha$. The arms 10' are formed as horizontal bars. The ends 11, 12 of the operating rod 7 are radially enlarged to form operating knobs.

Lock stud-recesses 13 are provided in the rear wall 4 of the second electronic unit 2 corresponding to the lock studs 10. In these lock stud recesses 13 the lock studs 10 engage, when the electronic units 1,2 are pushed together in the direction of the arrows 14 in FIG. 3b. Thus the starting position for the subsequent locking process is clearly shown.

Each lock stud recess 13 borders laterally on running surfaces 15, which are divided by a horizontal slot 16, whose width corresponds approximately to the width of the arms 10'.

A housing wall portion 17, which extends parallel to the running surfaces 15, acts as a stop for the connection motion of the studs 10 in the direction of the arrow 14. This housing wall portion 17 also serves as a housing closure member in the vicinity of the lock stud recess 13 and as a guide for the lock studs 10 in the following described locking motion.

Figures 3A, 3B, 3C:
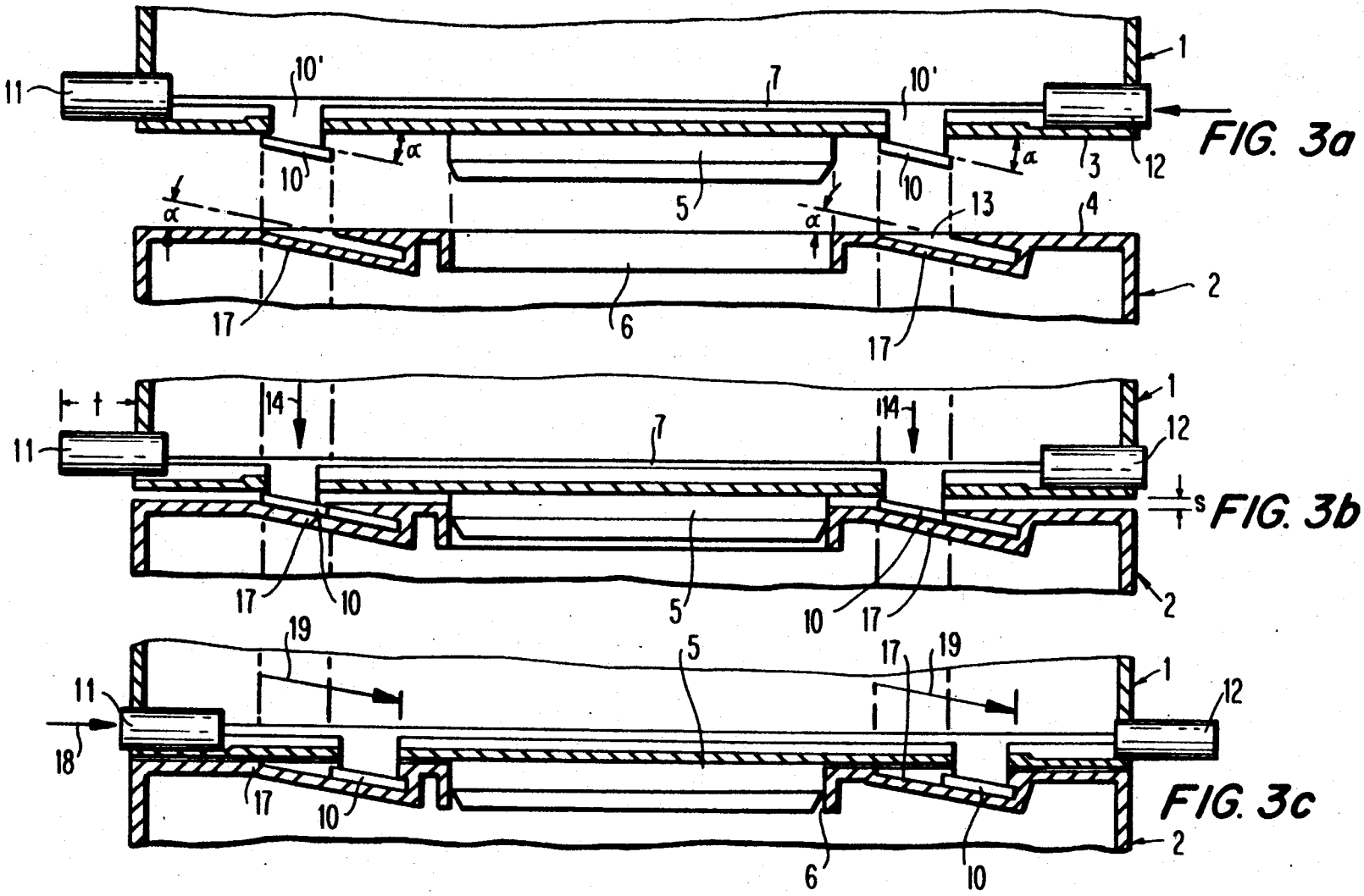
FIGS. 3a, 3b and 3c are cross-sectional action views of the two electronic units during the connection process showing different stages in the connecting.

Based on the position shown in FIG. 3*b* the left end in FIG. 3 of the operating rod 7 is pressed to the inside, so that on the side opposite the lateral wall 9 the end 12 of the operating rod 7 is pushed out from the housing(arrow 18). Since the running surfaces are positioned against the rear wall 4 exactly at the same angle $\alpha$ as the lock studs 10 make with the rear wall 3, the lock studs 10 can be brought now in the direction of the arrow 19 into the end position indicated in FIG. 3c, in which the electronic units 1,2 are completely connected mechanically, and in which also the electrical plug connection is finally made between the plug 5 and the socket 6. The traversal of the motion path t (see FIG. 3b) requires a corresponding displacement perpendicular to it according to the chosen angle $\alpha$, i.e. this latter displacement requiring an increased applied force, which can be surmounted by a comparatively effortless operating motion.

The release of the locking between the electronic units occurs in the reverse manner, i.e. starts from the position shown in FIG. 3*c*, in which the end 12 of the operating rod 7 is pressed into the interior of the device, so that the lock studs 10 are guided in the lock stud recesses 13 through the housing wall 17, so that the electronic units 1,2 can again be disconnected from each other without problem.

Figure 4:
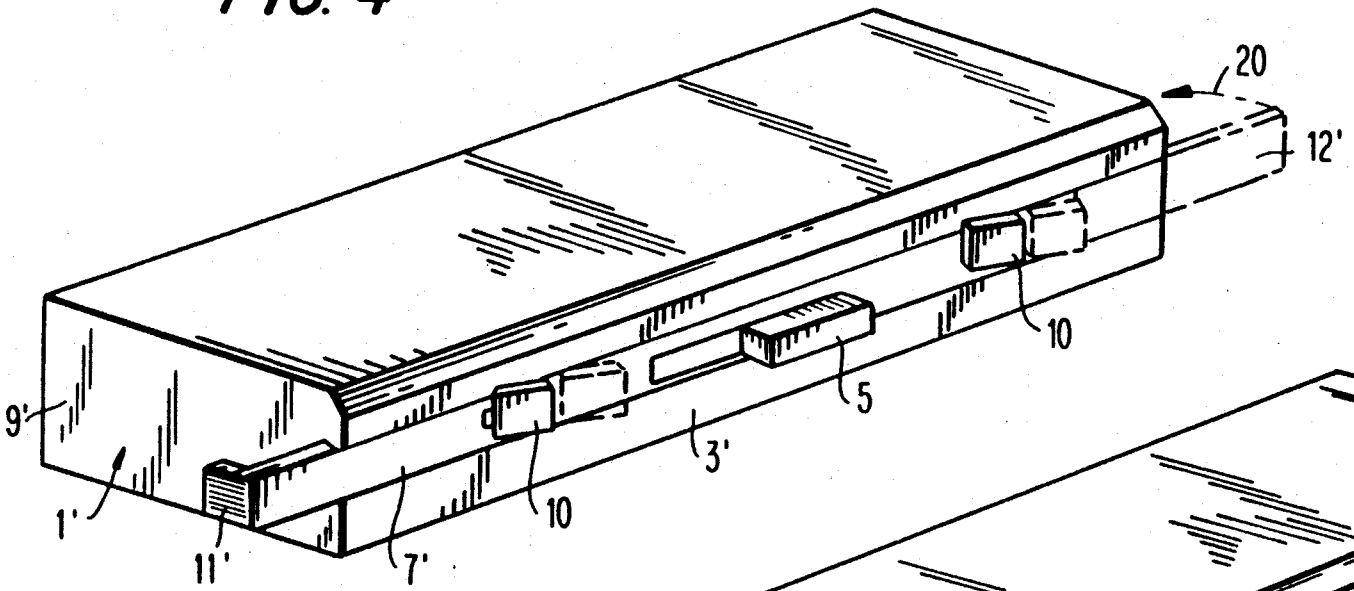
FIG. 4 is a perspective view of a first housing unit in a modified embodiment with plate-like operating bar.
Figure 5:
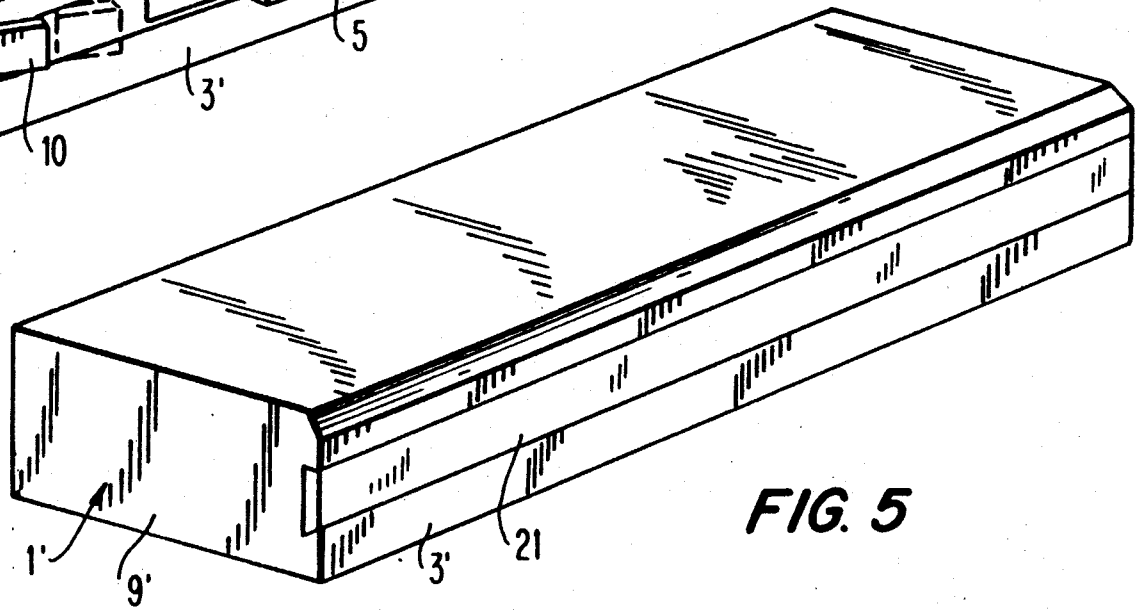
FIG. 5 is a perspective view of another housing unit according to FIG. 4, but with the operating bar removed and the ornamental strip in place.

The embodiment shown in FIGS. 4 and 5 operates in regard to the locking process in the same way. In this embodiment, the operating rod 7' is formed plate-like and is guided in a dovetail guide in the rear wall 3', so that the outer side of the plate-like operating rod 7' is aligned with the rear wall 3'. Also in this example the ends 11'and/or 12' protrude beyond the side wall 9', so that, in the locking position analogous to the position according to FIG. 3, the end 12' extending to the outside of the plate-like operating rod 7' is foldable in the direction of the arrow 20 to the side wall 9'.

When one type of electronic unit 1' without plug and locking mechanism is supplied, a cover plate 21 can be replaced by a plate-like operating bar 7' insertable in the same way, as illustrated in FIG. 5. To avoid damage to the plug 5 on connection of the electronic units 1,2, the plate-like guide shoulders 22 can be provided on each side of the plug 5. The plate-like guide shoulders 22 are useful as guide members during the connection of the plug 5 in the socket 6.

It will be understood that each of the elements described above, or two or more together, may also find a useful application in other types of constructions differing from the types described above.

While the invention has been illustrated and described as embodied in a plug connection device for mechanical and electrical connection of electronic units, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A plug connection device for mechanical and electrical connection of a first electronic unit with a second electronic unit, said connection device comprising an electronic plug (5) provided in an outer wall (3) of a first housing (1) of a first electronic unit, the first housing having at least one side wall (9) connected to the outer wall (3) of the first housing (1); a plug socket (6) provided in an outer wall (4) of a second housing (2) of a second electronic unit, the electronic plug (5) being electrically connectable with the plug socket (6); and a mechanical locking means separate from the electronic plug (5) and plug socket (6), said mechanical locking means comprising an operating device including an operating rod (7) protruding from the at least one side wall (9) of the first housing (1) and moveable substantially parallel to the outer wall (3) of the first housing (1); at least two plate-like lock studs (10), each of the plate-like lock studs (10) being connected to the operating rod (7) by an arm (10'), extending from the first housing (1) and being inclined to the outer wall (3) at an angle $\alpha$; a lock stud recess (13) provided in the outer wall (4) of the second housing (2) for each of the plate-like lock studs (10), each of the plate-like lock studs being engageable in one of the lock stud recesses (13), and each of the lock stud recesses (13) being bounded by an inclined running surface (15) provided in the outer wall (4) of the second housing (2) and a corresponding housing wall portion (17) extending parallel to the running surface (15) and being spaced therefrom a distance corresponding approximately to a thickness of the plate-like lock studs, each of the inclined running surfaces (15) being inclined substantially at the angle $\alpha$ to the outer wall (4) of the second housing (2) and having a horizontal slot (16) in which one of the arms (10') is slidable; and lateral plate-like guide shoulders (22) projecting from the outer wall (3) in the vicinity of the electronic plug (5) on the first housing (1) and engagable on each side of the plug socket (6) in the second housing (2) to provide additional guidance during connection of the electronic plug and the plug socket (6), so that, when the lock studs (10) are engaged in the lock stud recesses (13) and the operating rod (7) is moved so that the first and second electronic units are pulled together and the lock studs (10) contact and run on the running surfaces (15), the electronic plug (5) is connected simultaneously electrically and mechanically with the plug socket (6).

2. The plug connection device as defined in claim 1, wherein the first housing (1) has two opposing ones of the side walls attached to the outer wall (3) at opposite ends thereof and the operating rod (7,7') has two end positions, in one of the end positions the operating rod (7,7') protrudes from one of the side walls and is substantially flush with the other of the side walls, while in the other end position the operating rod (7,7') protrudes from the other side wall and is substantially flush with the one side wall.

3. A plug connection device for mechanical and electrical connection of a first electronic unit with a second electronic unit, said connection device comprising an electronic plug (5) provided in an outer wall (3') of a first housing (1') of a first electronic unit, the first housing having at least one side wall (9) connected to the outer wall (3'); a plug socket (6) provided in an outer wall (4) of a second housing (2) of a second electronic unit, the electronic plug (5) being electrically connectable with the plug socket (6); and a mechanical locking means separate from the electronic plug (5) and plug socket (6), said mechanical locking means comprising an operating device including a plate-like operating bar (7') having a free outer side and protruding from the at least one side wall (9) of the first housing (1) and moveable substantially parallel to the outer wall (3') of the first housing (1'), the plate-like operating bar (7') having a cross-section shaped for guiding and being longitudinally slidable in the outer wall of the first housing (1'), the free outer side of the plate-like operating bar (7') being aligned with the outer wall of the first housing (1'); at least two plate-like lock studs (10), each of the plate-like lock studs (10) being connected to the operating bar (7') by an arm (10'), extending from the first housing (1') and being inclined to the outer wall (3') at an angle $\alpha$; a lock stud recess (13) provided in the outer wall (4) of the second housing (2) for each of the plate-like lock studs (10), each of the plate-like lock studs being engageable in one of the lock stud recesses (13), and each of the lock stud recesses (13) being formed and bounded by an inclined running surface (15) provided in the outer wall (4) of the second housing (2) and a corresponding housing wall portion (17) extending parallel to the running surface (15) and being spaced therefrom a distance corresponding approximately to a thickness of the plate-like lock studs, each of the inclined running surfaces (15) being inclined substantially at the angle $\alpha$ to the outer wall (4) of the second housing (2) and having a horizontal slot (16) in which one of the arms (10') is slidable; and lateral plate-like guide shoulders (22) projecting from the outer wall (3') in the vicinity of the electronic plug (5) on the first housing (1') and engagable on each side of the plug socket (6) in the second housing (2) to provide additional guidance during connection of the electronic plug (5) and the plug socket (6), so that, when the lock studs (10) are engaged in the lock stud recesses (13) and the operating bar (7') is moved so that the first and second electronic units are pulled together and the lock studs (10) contact and run on the running surfaces (15), the electronic plug (5) is connected simultaneously electrically and mechanically with the plug socket (6).

4. The plug connection device as defined in claim 3, wherein the cross-section of the operating bar (7') is T-shaped.

5. The plug connection device as defined in claim 3, wherein the cross-section of the operating bar (7') is dovetailed.

6. The plug connection device as defined in claim 3, wherein the operating bar (7') is foldable so as to be alignable with the side wall (9) in an end position when the electronic units (1,2) are connected mechanically with each other.

7. The plug connection device as defined in claim 3, wherein the operating bar (7') is replaceable by a slidable form-fitting cover plate (21).

8. A plug connection device for mechanical and electrical connection of a first electronic unit with a second electronic unit, said connection device comprising an electronic plug (5) provided in an outer wall (3) of a first housing (1) of a first electronic unit, the first housing having at least one side wall (9); a plug socket (6) provided in an outer wall (4) of a second housing (2) of a second electronic unit, the electronic plug (5) being electrically connectable with the plug socket (6); and a mechanical locking means separate from the electronic plug (5) and plug socket (6), said mechanical locking means comprising an operating device including an operating rod (7) protruding from the at least one side wall (9) of the first housing (1) and moveable substantially parallel to the outer wall (3) of the first housing (1), at least two plate-like lock studs (10), each of the plate-like lock studs (10) being connected to the operating rods (7) by an arm (10'), extending from the first housing (1) and being inclined to the outer wall (3) at an angle $\alpha$; and a lock stud recess (13) provided in the outer wall (4) of the second housing (2) for each of the plate-like lock studs (10), each of the plate-like lock studs being engageable in one of the lock stud recesses (13), and each of the lock stud recesses (13) being formed and bounded by an inclined running surface (15) provided in the outer wall (4) of the second housing (2) and a corresponding housing wall portion (17) extending parallel to the running surface (15) and being spaced therefrom a distance corresponding approximately to a thickness of the plate-like lock studs, each of the inclined running surfaces (15) being inclined substantially at the angle $\alpha$ to the outer wall (4) of the second housing (2) and having a horizontal slot (16) in which one of the arms (10') is slidable, so that, when the lock studs (10) are engaged in the lock stud recesses (13) and the operating rod (7) is moved so that the first and second electronic units are pulled together and the lock studs (10) contact and run on the running surfaces (15), the electronic plug (5) is connected simultaneously electrically and mechanically with the plug socket (6).

* * * * *